US010602857B1

(12) United States Patent
Harris

(10) Patent No.: US 10,602,857 B1
(45) Date of Patent: Mar. 31, 2020

(54) SECONDARY TRAY APPARATUS FOR HIGH CHAIRS

(71) Applicant: Richard James Harris, Columbus, OH (US)

(72) Inventor: Richard James Harris, Columbus, OH (US)

( * ) Notice: Subject to any disclaimer, the term of this patent is extended or adjusted under 35 U.S.C. 154(b) by 0 days.

(21) Appl. No.: 15/661,420

(22) Filed: Jul. 27, 2017

(51) Int. Cl.
*A47D 15/00* (2006.01)
*A47D 1/00* (2006.01)

(52) U.S. Cl.
CPC ..... *A47D 1/0085* (2017.05)

(58) Field of Classification Search
CPC ..... A47G 23/06; A47G 19/06; A47G 21/001; A47G 19/2261; B65D 81/3453; A47D 1/008; A47D 1/04; A47C 1/11
See application file for complete search history.

(56) References Cited

U.S. PATENT DOCUMENTS 1,098,218 A 5/1914 Boileau
1,135,269 A * 4/1915 Dudley ..... A47B 13/08 108/27
1,371,475 A * 3/1921 Ernst ..... A47D 1/008 297/130
2,022,955 A 12/1935 Davis
2,582,373 A 1/1952 Cordrey
2,679,288 A 5/1954 Larger
3,330,597 A 7/1967 Lay et al.
3,538,976 A 11/1970 Gilbert
3,729,037 A 4/1973 Dare
3,788,699 A * 1/1974 Starr ..... A47D 1/008 297/153
3,848,921 A 11/1974 Rhodes
4,030,748 A 6/1977 Brock
4,100,633 A 7/1978 Pintos
4,131,312 A 12/1978 Price
4,360,053 A 11/1982 Buckner
4,449,763 A 5/1984 Barnett
4,579,385 A 4/1986 Koenig
4,597,698 A 7/1986 Liebetrau
4,606,576 A 8/1986 Jones
4,640,033 A 2/1987 Bulger
4,723,813 A 2/1988 Kassai
4,841,878 A 6/1989 Kriegsman
4,865,111 A 9/1989 Perutz
4,923,249 A 5/1990 Mattox
4,944,968 A 7/1990 Wagner
(Continued)

*Primary Examiner* — Shin H Kim
(74) *Attorney, Agent, or Firm* — Dickinson Wright PLLC

(57) ABSTRACT

A secondary tray apparatus for a child's high chair of the type having each of a seat and a tray with an eating surface that is coupled to the high chair. The secondary tray apparatus includes an eating surface bounded along a first side by an inner edge and is otherwise bounded by a wall having inner and outer sides. The wall extends upwardly from the eating surface to a height of at least 4" above said eating surface, with at least the inner side of the wall angled away from the eating surface. Securing means coupled to the tray apparatus permit securely coupling the secondary tray apparatus on top of a high chair tray. In the state of being secured on top of a high chair tray, the inner edge is positioned so as to confront a child seated in the high chair, and the wall is disposed so as to define a surface for containing items placed on the eating surface.

18 Claims, 11 Drawing Sheets

(56) References Cited

U.S. PATENT DOCUMENTS 4,989,742 A * 2/1991 Powell ..... A47G 19/06 206/549
5,007,674 A 4/1991 Franc
5,074,616 A 12/1991 Smith
5,135,436 A * 8/1992 Levy ..... F24F 13/0604 454/306
5,294,172 A 3/1994 Dubus
5,348,368 A 9/1994 Garcia
D366,375 S * 1/1996 Cross ..... D6/715
D409,026 S 5/1999 Rosko
5,964,534 A * 10/1999 Welles ..... A47G 21/001 229/87.08
6,158,052 A * 12/2000 Smith ..... A41B 13/10 2/46
6,497,452 B2 12/2002 Catelli
6,578,496 B2 6/2003 Guard
6,851,375 B2 2/2005 Guard
6,932,426 B2 8/2005 Greger
7,104,603 B2 * 9/2006 Keegan ..... A47D 1/004 297/151
7,131,714 B2 11/2006 Edelen
7,261,370 B1 8/2007 Whitesell, Jr.
7,690,158 B2 * 4/2010 Kelly ..... E04B 2/7429 181/291
9,516,946 B1 * 12/2016 Edwards ..... A47B 83/045
2003/0110674 A1 6/2003 Ernst
2003/0151285 A1 * 8/2003 Keegan ..... A47D 1/004 297/256.13
2009/0205995 A1 * 8/2009 Cox ..... A47G 19/06 206/561
2009/0223418 A1 * 9/2009 Ferrara ..... A45F 4/06 108/14
2011/0036745 A1 * 2/2011 Seter ..... A47G 19/06 206/565
2012/0211454 A1 * 8/2012 Wilson ..... A47D 1/008 211/133.6
2012/0273384 A1 * 11/2012 Jaswal ..... A47G 23/06 206/563
2013/0180936 A1 * 7/2013 Subbaraman ..... A47D 1/008 211/45
2015/0216320 A1 * 8/2015 Merlo ..... A47D 1/008 297/170
2016/0331152 A1 * 11/2016 Wells ..... A47D 15/00
2017/0226749 A1 * 8/2017 Fjetland ..... E04F 13/10

* cited by examiner

SECONDARY TRAY APPARATUS FOR HIGH CHAIRS

FIELD OF THE INVENTION

The present invention relates to accessory devices for high chairs of the type used for seating infants and young children.

BACKGROUND OF THE INVENTION

High chairs are commonly used to seat infants and young children during meals. High chairs have a seat for the infant or young child, and have a tray upon which the child's meal is placed. The tray is securely coupled to the frame of the chair.

Young children are frequently messy eaters. In addition to getting food all over themselves, their bibs and clothes, they throw and knock food off the high chair tray. The food that is displaced from the high chair tray lands on the floor and other nearby objects such as furniture, rugs, etc. The floor and other nearby objects must then be cleaned up, which creates extra work for the child's parents.

SUMMARY OF THE INVENTION

There is disclosed a secondary tray apparatus for a child's high chair of the type having each of a seat and a tray with an eating surface that is coupled to the high chair. The secondary tray apparatus includes an eating surface bounded along a first side by an inner edge, the eating surface being otherwise bounded by a wall having inner and outer sides. The wall extends upwardly from the eating surface to a height of at least 4" above the eating surface, and at least said inner side of the wall is angled away from the eating surface. Securing means are coupled to the tray apparatus for securely coupling the secondary tray apparatus on top of a high chair tray. In the state of being secured on top of the high chair tray, the inner edge is positioned so as to confront a child seated in the high chair, and the wall is disposed so as to define a surface for containing items placed on the eating surface.

According to one feature of the present invention, the eating surface is characterized by a crowned surface which is raised, proximate a central area of the eating surface, relative to the area of the eating surface outside of the central area.

Per another feature, a raised barrier extends along the inner edge of the eating surface. The raised barrier extends upwardly to a height that is lower than the height of the wall.

According to still another feature, the securing means comprise a pair of straps secured to a bottom surface of the tray apparatus which is opposite the eating surface.

In one form, first ends of the pair of straps are connected to the bottom surface of the tray apparatus at a first, common location, while separate second and third ends are connected to the bottom surface of the tray apparatus at second and third locations, respectively.

In one form of the invention, the wall is generally planar, such that the inner and outer sides of the wall are generally parallel to each other.

In another form, the inner and outer sides of the wall are not parallel relative to each other.

BRIEF DESCRIPTION OF THE DRAWINGS

The present invention will be described in greater detail with reference to the accompanying drawings, which illustrate exemplary embodiments of the invention, wherein.

DESCRIPTION OF PREFERRED EMBODIMENT

Figure 1:
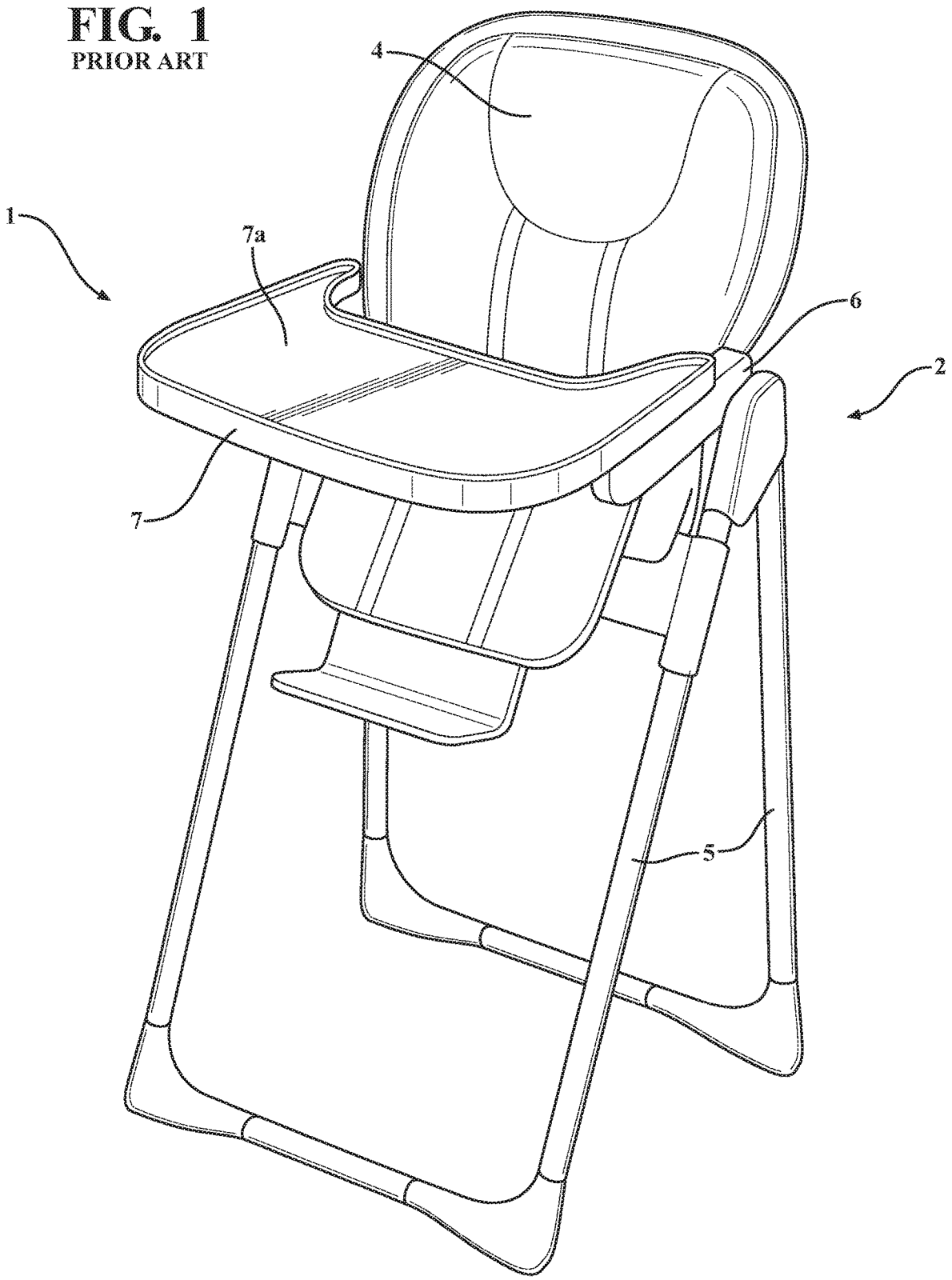
FIG. 1 PRIOR ART
FIG. 1 depicts a conventional high chair of a type which may be used in connection with the present invention.
Figure 2:
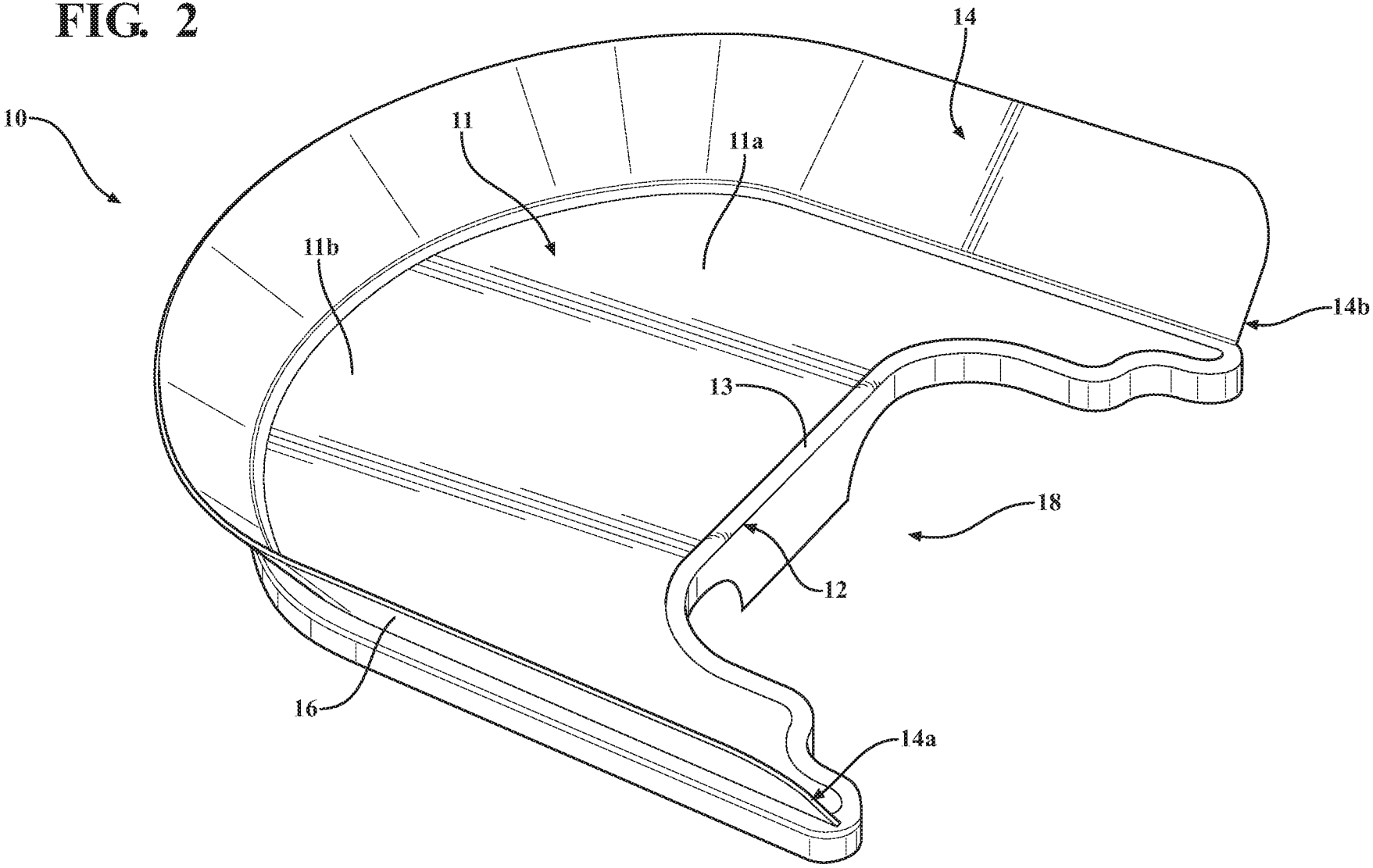
FIGS. 2 and 3 are perspective views of the secondary tray apparatus of the present invention according to a first embodiment.
Figure 3:
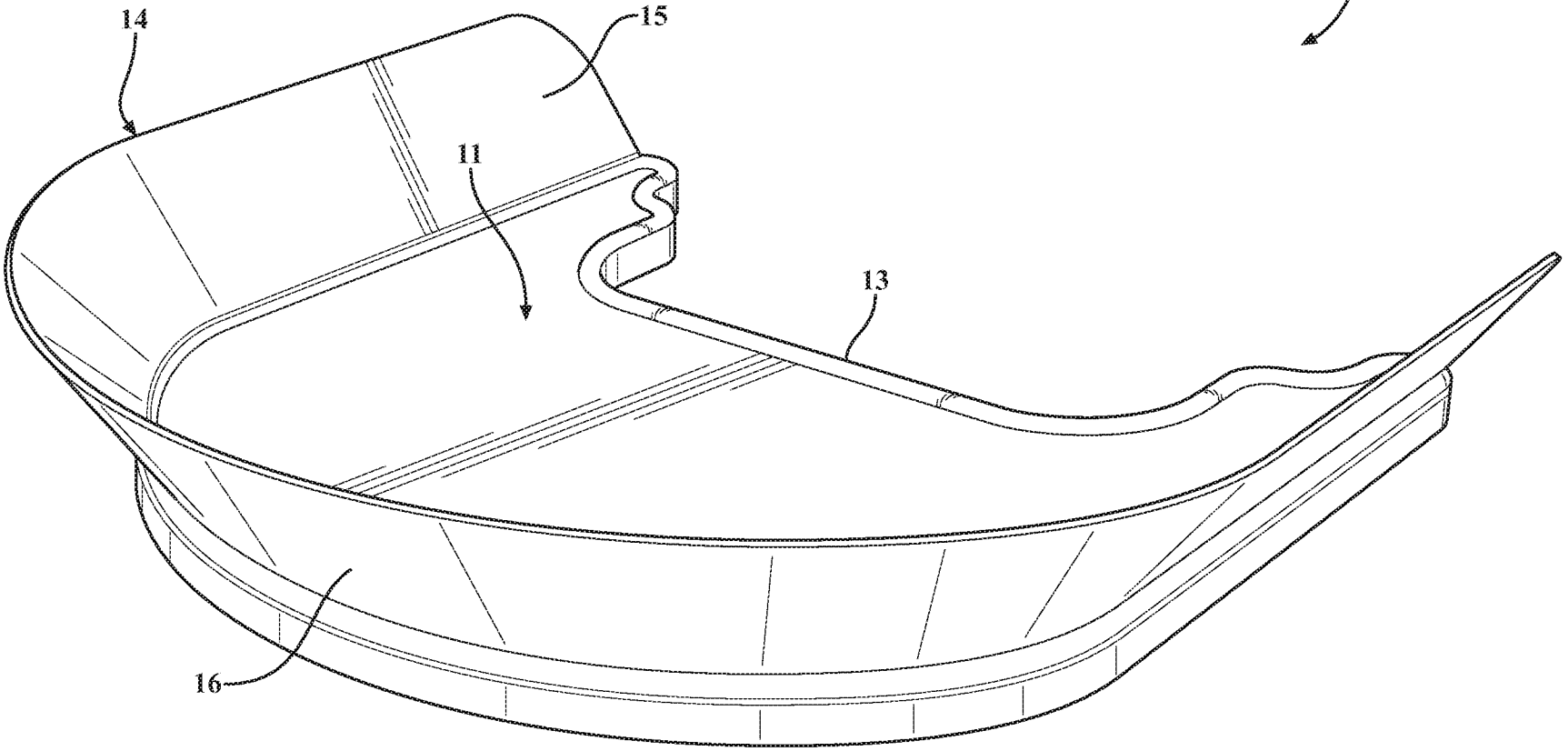

Referring now to the drawings, there is shown in FIG. 1 an exemplary high chair 1 of the type which may be used in conjunction with the present invention. Per convention, the high chair 1 includes a chair frame 2 having a seat 3, seat back 4, legs 5, and arms 6. A tray 7 is removably coupled to the arms 6. The tray 7 has a flat surface 7*a* that forms an eating area. Typically, a very short, upwardly-extending lip surrounds the eating area in order to contain liquids that may be spilled in the tray. A restraining belt is also commonly provided in the area of the seat 3 to restrain the child in a seated position in the high chair 1.

It will be understood with reference to the disclosure herein that the present invention may be adapted to utilization with a wide variety of conventional high chairs and, thus, that the exemplary high chair of FIG. 1 is not intended to be limiting of the invention.

Turning next to FIGS. 2 through 5C, the present invention will be seen, in an exemplary embodiment, to be a secondary tray apparatus (indicated generally at 10) for a high chair, such as, for instance, the high chair 1 of FIG. 1. Generally, the secondary tray apparatus 10 includes an eating surface 11 bounded along a first side by an inner edge 12. The rest of the eating surface 11 is bounded by a relatively higher, sloped wall 14 having inner 15 and outer 16 sides.

The wall 14 extends upwardly from the eating surface 11 to a height of at least 4" above the eating surface. At least the inner side 15 of the wall 14 is angled away from the eating surface 11. Each of the height and angle of the wall 14 are selected to retain objects on the eating surface 11 and, correspondingly, to block them from being pushed off of the apparatus by a child when the apparatus is in use. In this manner, the wall 14 serves not only to retain spilled liquids on the eating surface, but also to more generally discourage, minimize or even prevent other items—including food and toys—from being pushed off of the eating surface and onto the floor.

Figure 5A:
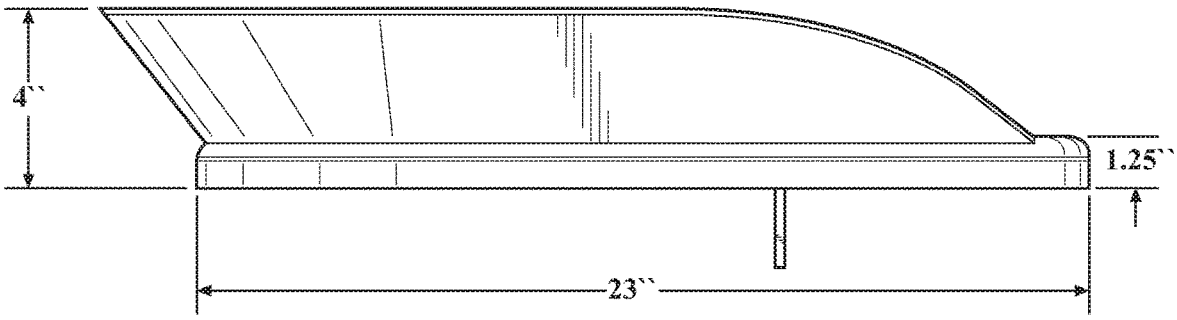
FIGS. 5A through 5C are lateral views of the tray apparatus, showing several exemplary wall heights for purposes of comparison.
Figure 5B:
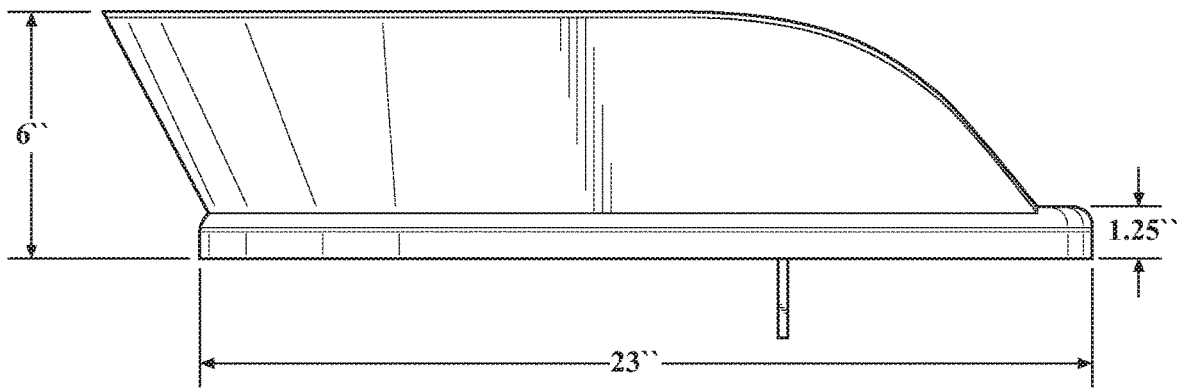
Figure 5C:
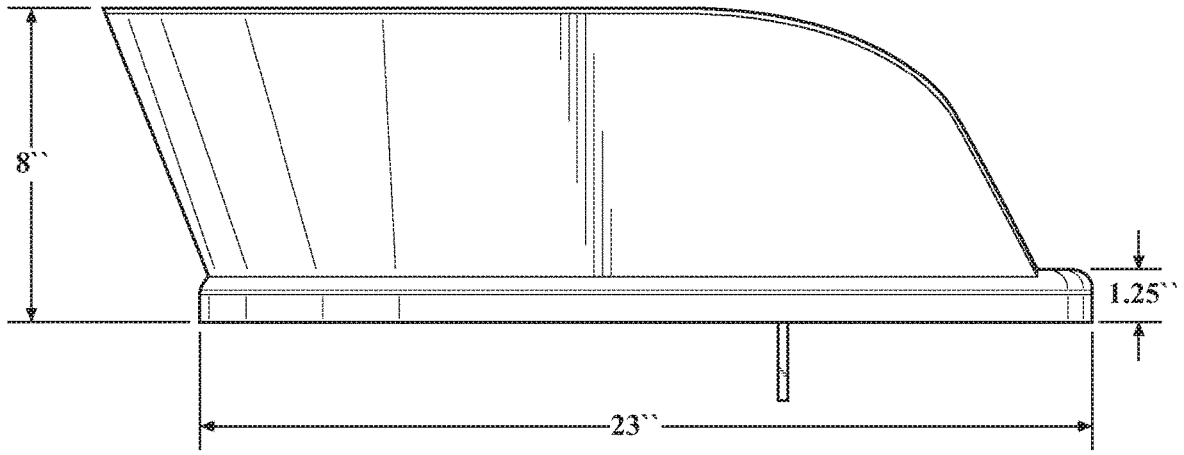

Other exemplary embodiments of the present invention contemplate that the height of the wall may be any of 4" (FIG. 5A), 6" (FIG. 5B) or 8" (FIG. 5C) above the eating surface. These possible heights of the wall 14 are shown in FIGS. 5A through 5C, which depict each of the exemplary wall heights (4", 6", and 8"). Of course, other heights of the wall 14 above at least 4" may be selected.

Referring again to FIGS. 2 and 3, the inner edge 12 will be seen to be positioned inwardly from the extreme left 14*a* and right 14*b* ends of the wall 14, thereby defining an open area 18. This open area 18 defines a partial space for a child seated in the high chair when the apparatus 10 is secured thereto while, simultaneously, permitting the wall 14 to extend somewhat to the left and right-hand sides of the child and thereby increase the protection afforded by the wall 14.

Figure 4:
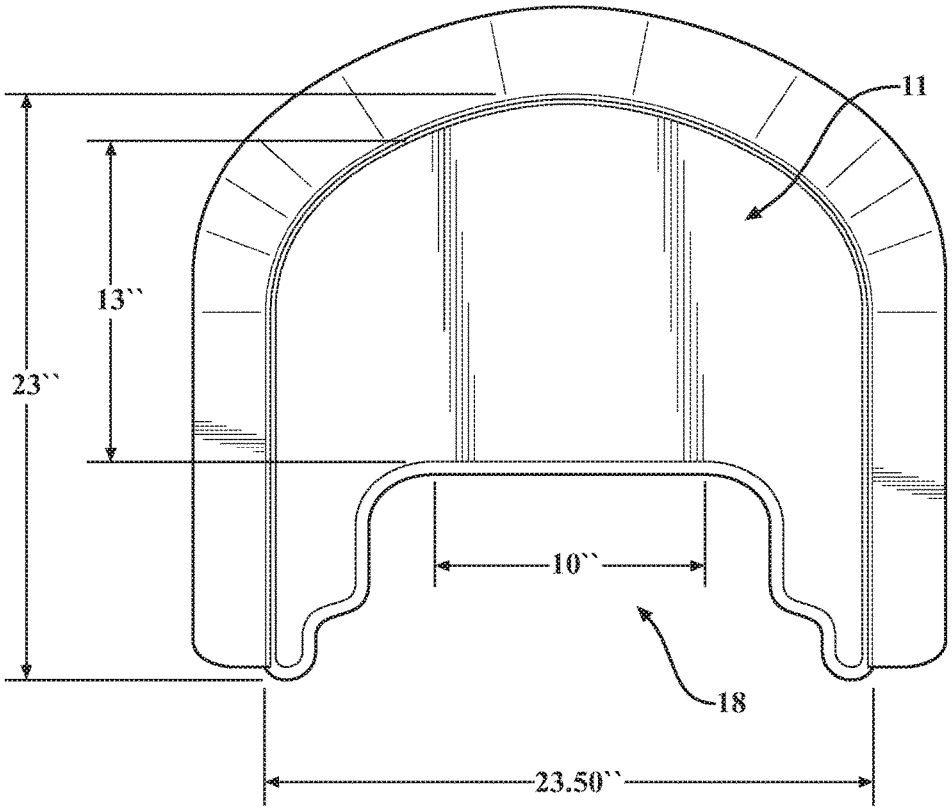
FIG. 4 is a top plan view of the eating surface of the tray apparatus, showing exemplary dimensions thereof.

With particular reference to FIGS. 4 through 5C, exemplary dimensions for the apparatus 10 are provided. From these, it can be seen that an exemplary overall length is given at 23", an exemplary overall width is given at 23.5", and an exemplary eating surface length is given at approximately 13". While these dimensions, and the overall shape, for the exemplary embodiment have been selected to maximize the compatibility of the apparatus 10 with the trays of existing high chairs, it will be appreciated that other shapes and dimensions of the apparatus 10 may be selected. For instance, it is contemplated that the apparatus 10 may be designed to overlie a particularly shaped high chair tray, thereby making the apparatus uniquely compatible with that tray.

Figure 6:
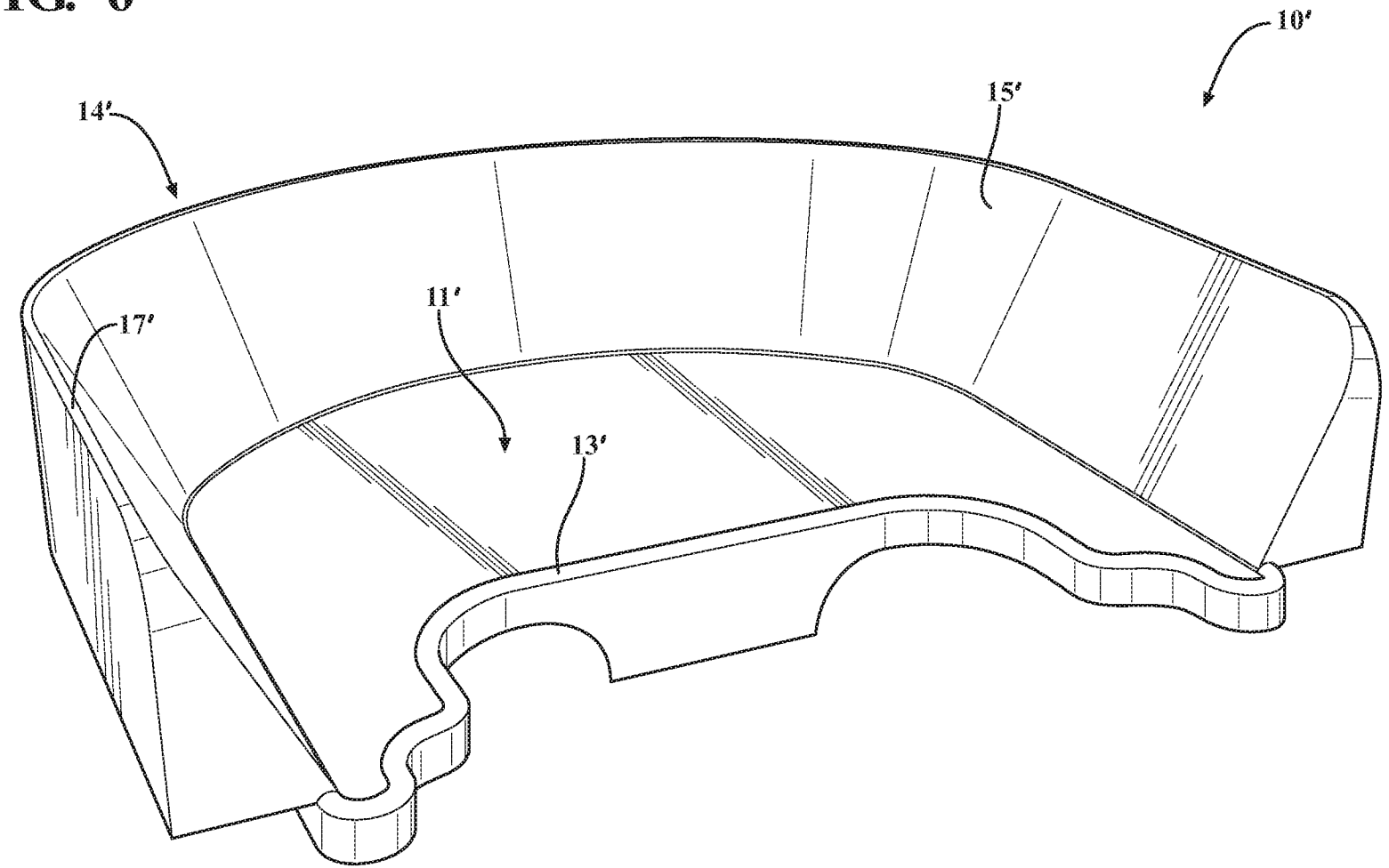
FIG. 6 is a perspective view of the tray apparatus according to another embodiment.
Figure 7:
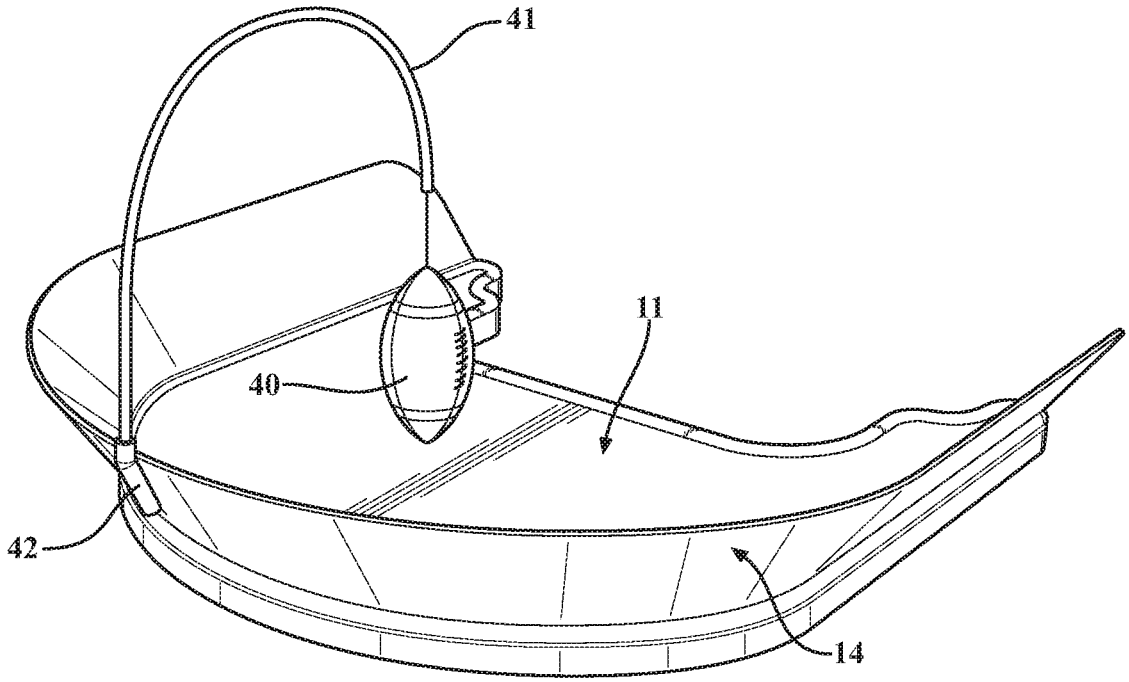
FIGS. 7 and 8 are perspective views of tray apparatuses of the present invention including an optional accessory.

In one form of the invention, shown in FIGS. 2 through 5C, the wall 14 is generally planar, such that the inner 15 and outer 16 sides of the wall are generally parallel to each other. In another embodiment, shown in FIG. 6, the inner 15' and outer 16' sides of the wall 14' are not parallel relative to each other. Instead, in the embodiment of FIG. 6, it will be seen that the inner side 15' of the wall 14' is angled away from the eating surface 11', whereas the outer side 16' is generally perpendicularly oriented, extending upwardly from the apparatus to intersect the inner side 15' at a top edge 17' of the wall 14'.

Optionally, the eating surface 11 of any of the embodiments of the invention herein may be characterized by a crowned surface which is raised, proximate a central area 11*a* of the eating surface, relative to the area of the eating surface outside of the central area and proximate the wall 14, designated 11*b*. Crowning of the surface tends to urge spilled liquids and the like toward the outside area of the eating surface 11, as will be appreciated by those skilled in the art.

Optionally, the apparatus according to any of the various embodiments disclosed herein may also include a slightly raised barrier 13 which extends along the inner edge 12 of the eating surface. The raised barrier 13, which serves primarily only to prevent spilled liquid from leaving the eating surface 11, extends upwardly to a height that is markedly lower than the height of the wall 14, so that a child can easily access the eating surface 11 when seated in the high chair.

Figure 8:
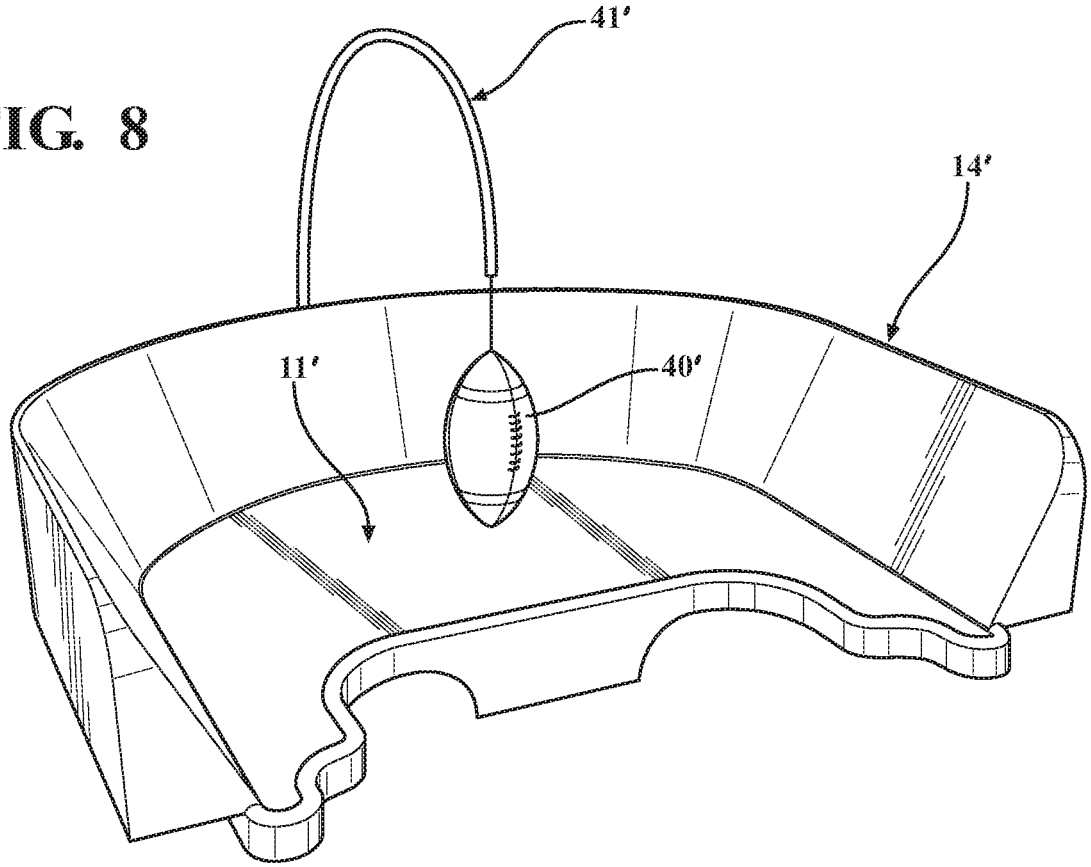
Figure 9:
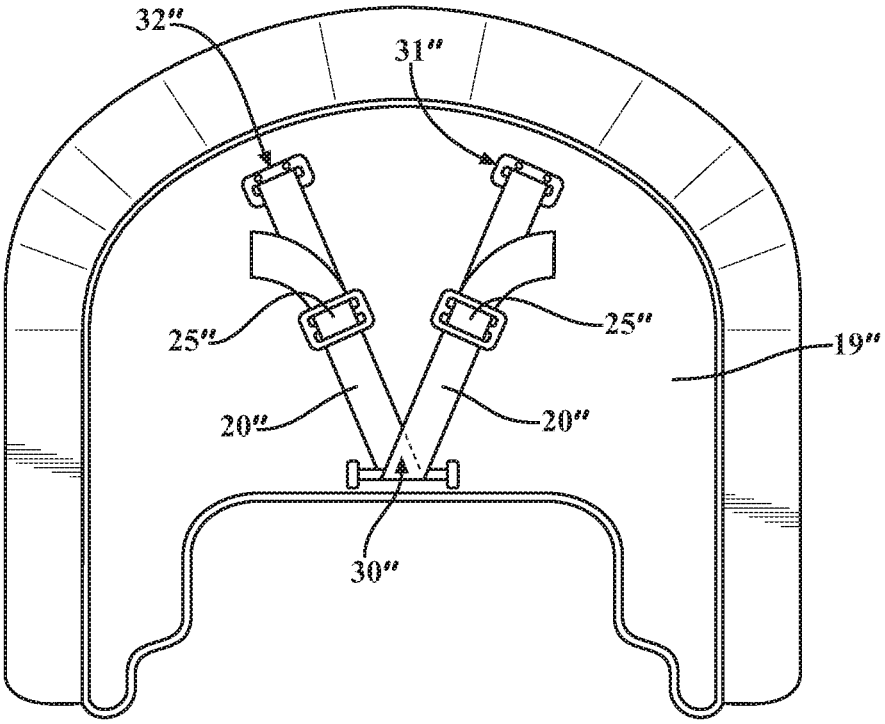
FIGS. 9 through 11 are bottom views of the tray apparatus, showing various embodiments of the securing means.

Optionally, the apparatus according to any of the various embodiments disclosed herein may also be modified to include one or more play accessories. For instance, there is shown in FIGS. 8 and 9 apparatuses according to the present invention which include a toy 40, 40' having the shape and appearance of a football, suspended from a support arm 41, 41' so as to dangle above the eating surface 11, 11'. Support arm 41, 41' is secured to the wall 14, 14'. According to the exemplary embodiment, a bracket or holder 42 (not visible in FIG. 9) is provided on the wall 14 and includes an opening for receiving therein an end of support arm 41, thereby permitting the toy to be removed or installed as desired.

As described hereinbelow, the secondary tray apparatus 10 is adapted to be secured over top of the tray of a high chair, such as the tray 7 of the high chair 1 described above. To this end, securing means are coupled to the tray apparatus 10 for securely coupling the secondary tray apparatus on top of the high chair tray 7.

Referring more specifically to FIGS. 10 through 14, the securing means according to the illustrated embodiments generally comprise a pair of straps 20 secured to a bottom surface 19 of the tray apparatus 10 (which bottom surface 19) is positioned oppositely, and beneath, the eating surface 11. In the exemplary embodiments, first ends of the pair of straps 20 are connected to the bottom surface 19 of the tray apparatus at a first, common location 30, while separate second and third ends are connected to the bottom surface 19 of the tray apparatus at second 31 and third 32 locations, respectively.

Figure 10:
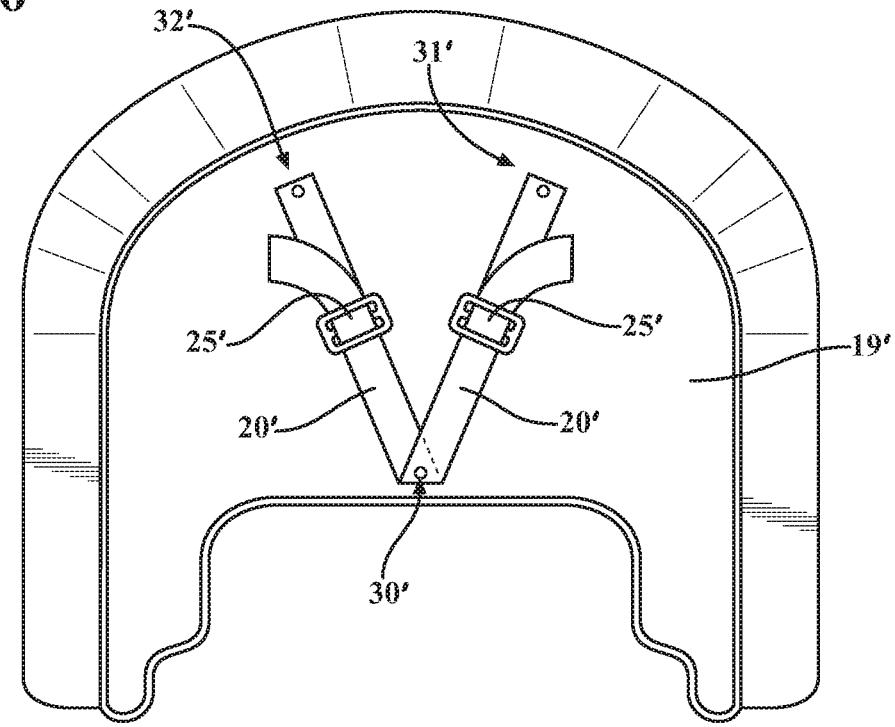
Figure 11:
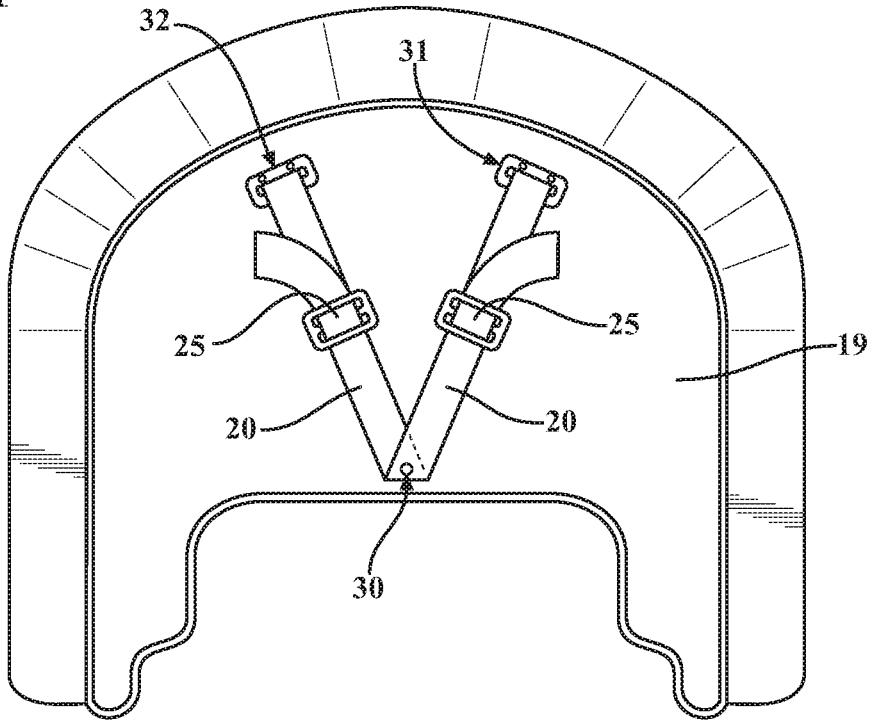
Figure 12:
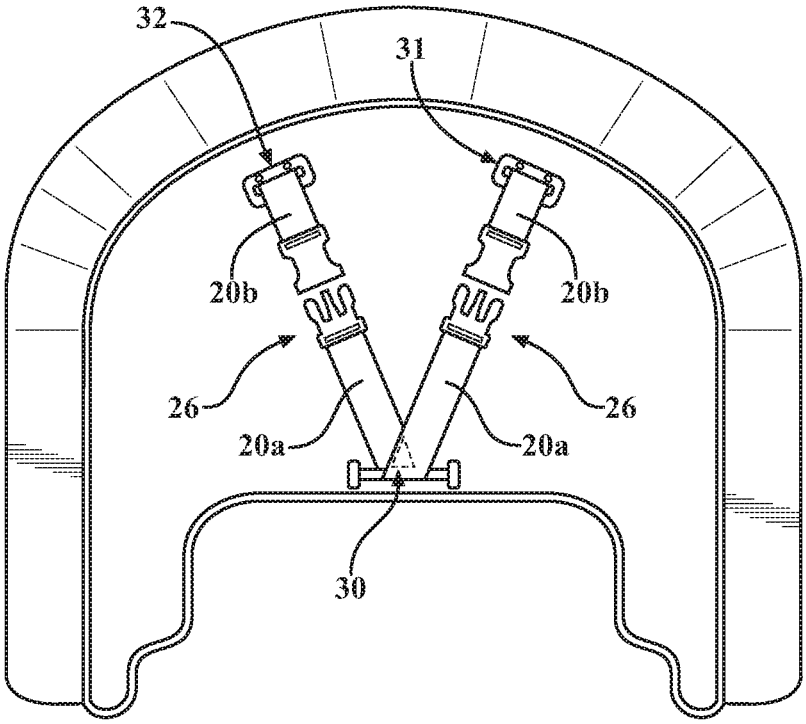
FIGS. 12 and 13 depict further embodiments of the securing means.

As shown in FIGS. 10 through 12, the connections at the second 31 (31', 31") and third 32 (32', 32") locations may take the form of rings secured to the bottom surface 19, with each of the second and third ends of the straps 20 being secured in one of such rings.

Also as shown in FIGS. 10 through 12, the connection at the first location 30 may take any of a variety of forms including, for instance: a bar of metal or the like which is secured to the bottom surface and over which the straps are connected (FIG. 10); a plurality of rivets which pass through the straps 20 and connect to the bottom surface 19; or a hook to which the straps are secured (FIG. 12).

Of course, any of the foregoing means for securing the straps 20 to the bottom surface 19 may be employed, and in any combination. Furthermore, other conventional means for securing the straps 20 to the bottom surface 19 may be substituted, subject only to the limitations identified herein.

Figure 13:
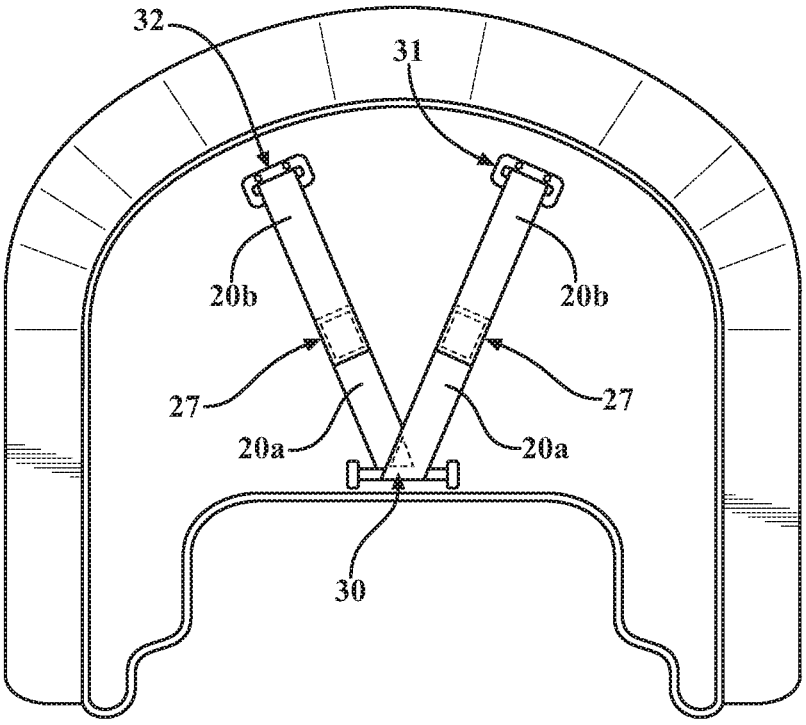
Figure 14:
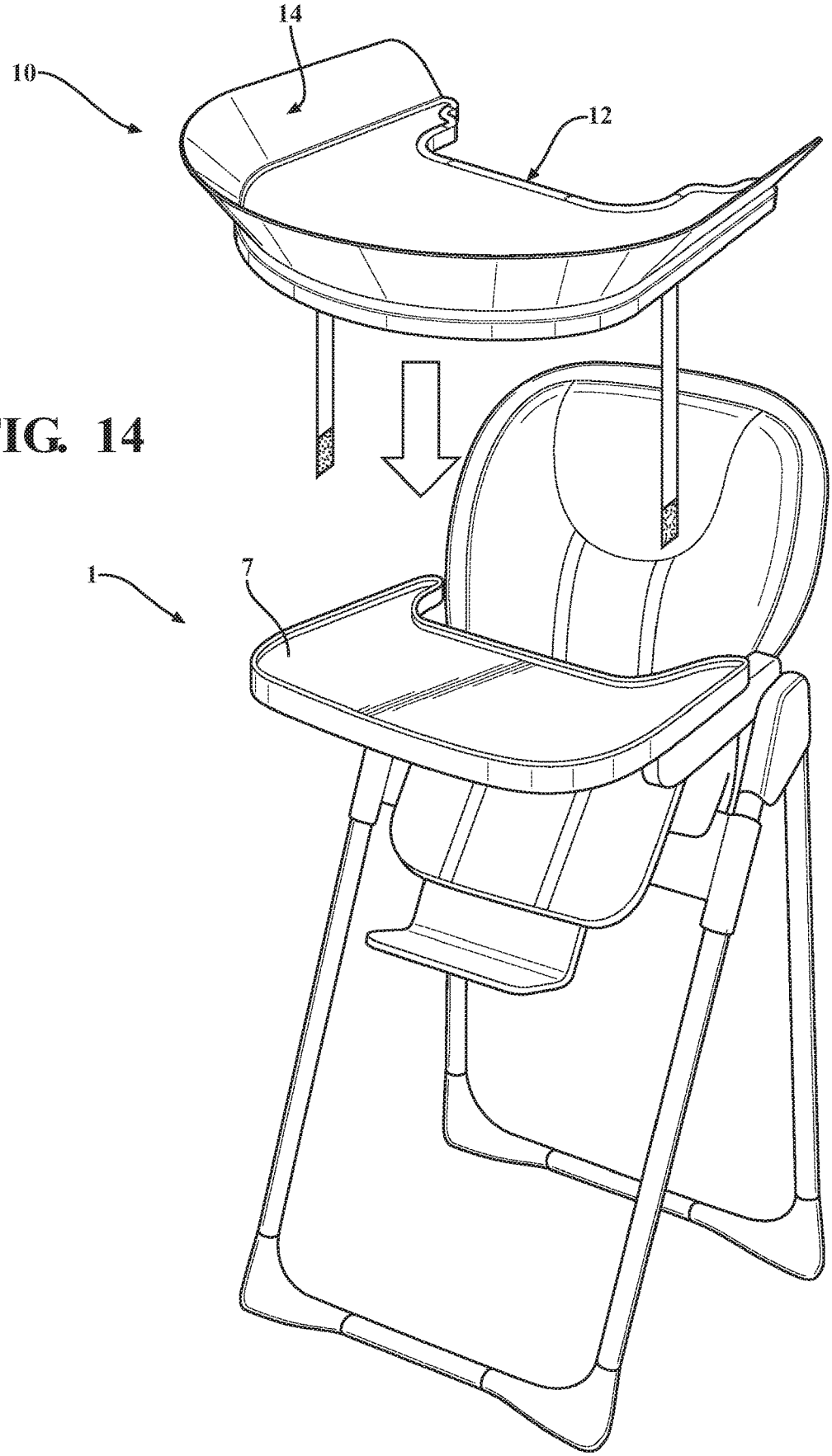
FIG. 14 schematically depicts the secondary tray apparatus of the present invention according to an exemplary manner of use thereof.

Each of the pair of straps 20 is adapted so as to be capable of adjustment to permit the apparatus 10 to be received over top of, and subsequently secured to, the tray of a high chair. With reference being had also to FIGS. 13 and 14, several optional means for achieving this may be better understood.

According to a first embodiment, shown in FIGS. 10 through 12, the straps 20 are adjustable in length and each includes a tri-glide buckle 25 which, according to convention, is disposed along the length of the strap and also receives therein a free end of the strap the length of which relative to the tri-glide buckle can be altered to likewise alter the overall length of the strap. By this means, the length of each strap 20 can be selectively lengthened to permit the straps to be received around the tray of the high chair and, thereafter, selectively shorted to securely hold the apparatus 10 in place on the high chair tray.

According to the foregoing embodiment, it will be appreciated that each strap 20 constitutes a length of strap material which is secured at the first location 30, threaded through the ring at the second or third location 31 or 32, respectively, and then doubled back to be received in the tri-glide buckle. Alternatively, the straps 20 may constitute a single length of strap material. Per this embodiment, the point of securement at the common first location 30 simply constitutes a location where the single length of strap material is doubled back upon itself.

Per another embodiment, shown in FIG. 13, adjustment of the straps 20 is accomplished by means of buckles 26. According to this embodiment, each separate strap 20 is subdivided along its length into two separate portions 20*a* and 20*b* the adjacent ends of which are secured to one of the complimentary male or female parts of the buckle 26. These complimentary parts of the buckle 26 are disconnected to permit the apparatus 10 to be brought down over top of a high chair tray. Once the apparatus is satisfactorily positioned on the tray, the complimentary parts of the buckle 26 are fastened to secure the apparatus in place.

In a final embodiment, shown in FIG. 14, adjustment of the straps 20 is accomplished by means of hook and loop type fasteners 27. Like the previously-described embodiment, each separate strap 20 is subdivided along its length into two separate portions 20*a* and 20*b* the adjacent ends of which include the complimentary portions of the hook and loop fastener. These complimentary portions are disconnected to permit the apparatus 10 to be brought down over top of a high chair tray. Once the apparatus is satisfactorily positioned on the tray, the complimentary portions of the hook and loop fastener 27 are brought together to secure the apparatus 10 in place.

Of course, the present invention is not limited to the foregoing means for securement thereof to the tray of a high chair. Other means, known to those skilled in the art, may be employed subject only to the limitations disclosed herein.

In the state of being secured on top of the high chair tray 7, the apparatus 10 is brought down (as indicated by the arrow in FIG. 15) over top of the high chair tray 7 so that the inner edge 12 is positioned so as to confront a child (not shown) seated in the high chair 1, and the wall 14 is disposed so as to define a surface for containing items placed on the eating surface (see FIG. 15). The securement means are then adjusted so as to permit the apparatus 10 to be seated on top of the tray 7, such that the bottom surface 19 contacts the upper, eating surface of the high chair tray 7. Thereafter, the securement means are once again adjusted so as to securely hold the apparatus 10 in place on the tray 7. As desired, the apparatus 10 may be subsequently removed from the tray 7 by a reverse of the foregoing process.

In the exemplary embodiments, the principal part of the apparatus—i.e., the wall, eating surface and bottom surface—may be molded from a suitable polymer so as to be of monolithic construction. Alternatively, the apparatus may be fashioned in multiple parts which are subsequently assembled to form a unitary whole. Optionally, it is also contemplated that the wall may be separately formed and selectively attachable to, and detachable from, the apparatus so that walls of different configurations—e.g., different heights—may be used in conjunction with the apparatus, as desired. For instance, it may be desirable in one situation to use a relatively shorter wall—e.g., 4" high; yet, in another situation, to employ a wall with a greater height—e.g., 8".

The above description of the invention is the preferred embodiment of the invention, however, the invention has other embodiments. The foregoing disclosure and the showings made in the drawings are merely illustrative of the principles of this invention and are not to be interpreted in a limiting sense.

The invention in which an exclusive property or privilege is claimed is defined as follows:

1. A secondary tray apparatus for a child's high chair of the type having each of a seat and a tray with an eating surface that is coupled to the high chair, the secondary tray apparatus comprising:

an eating surface bounded along a first side by an inner edge, and the eating surface otherwise bounded by a rigid wall having inner and outer sides, said wall formed integrally with and extending upwardly from said eating surface, and at least said inner side of said wall angled away from said eating surface; and wherein the secondary tray apparatus is adapted to be secured on top of a high chair tray, and wherein further, in the state of being secured on top of a high chair tray, the inner edge is positioned so as to confront a child seated in the high chair and the wall is disposed so as to define a surface for containing items placed on the eating surface.

2. The secondary tray apparatus of claim 1, wherein said eating surface is characterized by a crowned surface which is raised, proximate a central area of the eating surface, relative to the area of the eating surface outside of the central area.

3. The secondary tray apparatus of claim 1, wherein a raised barrier extends along said inner edge of the eating surface, the raised barrier extending upwardly to a height that is lower than the height of the wall.

4. The secondary tray apparatus of claim 1, comprising a pair of straps secured to a bottom surface of the tray apparatus which is opposite the eating surface, said straps configured to secure the secondary tray apparatus on top of a high chair tray.

5. The secondary tray apparatus of claim 4, wherein first ends of the pair of straps are connected to the bottom surface of the tray apparatus at a first location, and separate second and third ends are connected to the bottom surface of the tray apparatus at second and third locations, respectively.

6. The secondary tray apparatus of claim 1, wherein the wall is generally planar, such that the inner and outer sides of said wall are generally parallel to each other.

7. The secondary tray apparatus of claim 1, wherein the inner and outer sides of said wall are not parallel relative to each other.

8. The secondary tray apparatus of claim 1, wherein said wall extends upwardly from said eating surface to a height of at least 4" above said eating surface.

9. The secondary tray apparatus of claim 1, wherein the high chair tray is characterized by a first shape, and wherein further said secondary tray apparatus is configured to conform to said first shape.

10. A method for utilizing a secondary tray apparatus in connection with a child's high chair, comprising the following steps:

a) providing a child's high chair of the type having each of a seat and a tray with an eating surface that is coupled to the high chair;

b) providing a secondary tray apparatus adapted to be secured on top of the high chair tray, the secondary tray apparatus comprising an eating surface bounded along a first side by an inner edge, and the eating surface otherwise bounded by a rigid wall having inner and outer sides, said wall formed integrally with and extending upwardly from said eating surface, and at least said inner side of said wall angled away from said eating surface;

c) positioning the secondary tray apparatus so as to overlie the eating surface of the high chair tray and so that the inner edge of the secondary tray apparatus is positioned so to confront a child seated in the high chair and the wall is disposed so as to define a surface for containing items placed on the eating surface of the secondary tray apparatus; and d) securing the secondary tray apparatus in the position overlying the eating surface of the high chair tray.

11. The method of claim 10, wherein said eating surface is characterized by a crowned surface which is raised, proximate a central area of the eating surface, relative to the area of the eating surface outside of the central area.

12. The method of claim 10, wherein a raised barrier extends along said inner edge of the eating surface, the raised barrier extending upwardly to a height that is lower than the height of the wall.

13. The method of claim 10, wherein the secondary tray apparatus comprises a pair of straps secured to a bottom surface of the tray apparatus which is opposite the eating surface, said straps configured to secure the secondary tray apparatus on top of a high chair tray.

14. The method of claim 13, wherein first ends of the pair of straps are connected to the bottom surface of the tray apparatus at a first location, and separate second and third ends are connected to the bottom surface of the tray apparatus at second and third locations, respectively.

15. The method of claim 10, wherein the wall is generally planar, such that the inner and outer sides of said wall are generally parallel to each other.

16. The method of claim 10, wherein the inner and outer sides of said wall are not parallel relative to each other.

17. The method of claim 10, wherein said wall extends upwardly from said eating surface to a height of at least 4" above said eating surface.

18. The method of claim 10, wherein the high chair tray is characterized by a first shape, and wherein further the secondary tray apparatus is configured to conform to said first shape.

* * * * *